US006398998B1

(12) United States Patent
Krenchel et al.

(10) Patent No.: US 6,398,998 B1
(45) **Date of Patent: *Jun. 4, 2002**

(54) METHOD FOR PRODUCING BODIES OF CONSOLIDATED PARTICULATE MATERIAL

(75) Inventors: Herbert Krenchel, Hellerup; Helge Fredslund-Hansen, Rødovre; Henrik Stang, Nærum, all of (DK)

(73) Assignee: 3H Inventors ApS, Naerum (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/765,905

(22) PCT Filed: Jul. 7, 1995

(86) PCT No.: PCT/DK95/00296

§ 371 (c)(1),
(2), (4) Date: Jan. 7, 1997

(87) PCT Pub. No.: WO96/01726

PCT Pub. Date: Jan. 25, 1996

(30) Foreign Application Priority Data

Jul. 8, 1994 (DK) ..... 0830/94

(51) Int. Cl.[7] ..... B28B 3/20; B28B 3/22; B28B 3/24; B28B 21/52; B28B 1/26

(52) U.S. Cl. ..... 264/70; 264/86; 264/87; 264/108; 264/177.2; 264/426; 264/444; 264/464; 366/28; 366/31; 366/38; 425/84; 425/85; 425/432; 425/456

(58) Field of Search ..... 264/70, 444, 426, 264/464, 86, 87, 77.2, 108; 366/28, 31, 38; 425/84, 85, 432, 456

(56) References Cited

U.S. PATENT DOCUMENTS

| | | | | | |
|---|---|---|---|---|---|
| 1,693,429 | A | * | 11/1928 | Austin | |
| 1,989,409 | A | * | 1/1935 | Gordon | 264/69 |
| 2,408,627 | A | * | 10/1946 | Green | |
| 2,836,848 | A | * | 6/1958 | Zink et al. | 264/69 |
| 3,619,429 | A | * | 11/1971 | Torigai et al. | |
| 3,686,070 | A | * | 8/1972 | Williams | |
| 3,876,744 | A | * | 4/1975 | Onder | 264/105 |
| 3,926,541 | A | * | 12/1975 | Hewitt | 425/64 |
| 4,067,676 | A | * | 1/1978 | Hewitt | 425/64 |

(List continued on next page.)

FOREIGN PATENT DOCUMENTS

| | | | | |
|---|---|---|---|---|
| DE | 954039 | | 12/1956 | |
| DE | 955210 | | 2/1957 | |
| DE | 2 319 254 | * | 10/1974 | 264/70 |
| GB | 544275 | * | 4/1942 | 264/70 |
| JP | 5-200831 A | * | 8/1993 | B29C/47/16 |
| JP | 5-208439 A | * | 8/1993 | B29C/47/18 |
| JP | 11-75803 A | * | 3/1999 | A23P/1/12 |
| SE | 304711 | * | 9/1968 | |
| WO | 93/20990 | | 10/1993 | 264/173 |

*Primary Examiner*—Jan H. Silbaugh
*Assistant Examiner*—Michael I. Poe
(74) *Attorney, Agent, or Firm*—Larson & Taylor PLC

(57) ABSTRACT

A method for producing shaped bodies of particulate material by introducing an easily flowable slurry of water and particulate material into a mold with perforated walls and by applying a sufficiently high pressure to the slurry in the mold so as to express a sufficient proportion of the liquid to allow physical contact and interengagement between the particles. The method may be carried out continuously in an extrusion process including introducing the slurry under high pressure into a extruder and conveying the slurry through a shaping section of the extruder to a draining and consolidation section of the extruder with drain holes and slits whereby a non-flowable, consolidated, shaped body leaves the extruder through an exit section.

20 Claims, 2 Drawing Sheets

U.S. PATENT DOCUMENTS 4,133,619 A * 1/1979 Wise ..... 425/64
4,252,759 A * 2/1981 Yannas et al. ..... 264/86
4,674,971 A * 6/1987 Kankkunen ..... 425/381
4,832,890 A * 5/1989 Sato et al. ..... 264/87
4,917,587 A * 4/1990 Alpar et al.
5,059,371 A * 10/1991 Saheki et al. ..... 264/108
5,068,068 A * 11/1991 Furusawa et al. ..... 264/407
5,132,549 A * 7/1992 Allan et al. ..... 264/70
5,385,701 A * 1/1995 Awana et al. ..... 264/69
5,498,383 A * 3/1996 Marple et al. ..... 264/87
5,798,151 A * 8/1998 Andersen et al. ..... 428/34.5

* cited by examiner

METHOD FOR PRODUCING BODIES OF CONSOLIDATED PARTICULATE MATERIAL

TECHNICAL FIELD

The present invention relates to a method for producing shaped bodies.

BACKGROUND ART

A method of this kind is disclosed in BE-A-653,349 and SE-B-304,711 (both based on FR priority application No. 955,561 of Nov. 29, 1963). In this known method, an unhardened mixture comprising hydraulic cement and aggregate material (sand and gravel) with surplus water is compressed in an extruder of constant cross-sectional shape by means of a reciprocating piston, and in the terminal part of said extruder, the walls of which are suitably perforated, part of the water is removed by applying a vacuum to the outside of said walls, all this taking place while the material is moving slowly through the extruder.

Obviously, the pressure differential that can be produced by said vacuum arrangement is at the highest of the order of one bar. In addition to this, the reciprocating piston does, admittedly, exert a certain force, thus causing a corresponding increase in the pressure differential effecting the de-watering, but if sufficiently increased, this force will simply push the material out of the extruder, as no counter-force is provided to prevent this.

This means, of course, that the total pressure differential across the perforated walls will at the most be of the order of a few bar. This in turn means that the ability of this previously known method to remove liquid from the spaces between the particles of the material is limited, and in many cases the quantity of the remaining liquid is sufficient to prevent the shaped bodies produced from attaining more structural strength than just needed to keep their shape against the force of gravity, so that they, unless extreme care is taken, cannot be handled without deforming, collapsing or falling apart.

The above problem is, of course, less serious in the case of shaped bodies of clay, as such bodies can be allowed to or be made to harden respectively be well-known methods before being moved, but the method referred to above is obviously insufficient, if the shaped bodies are to have a reasonable strength immediately upon having been produced by carrying out the method.

DISCLOSURE OF THE INVENTION

It is the object of the present invention to provide a method of the kind referred to initially, with which it is possible to produce shaped bodies having a considerable mechanical strength, so that they can be handled or manipulated mechanically immediately upon completion of the final step of the method without any risk of deforming, collapsing or falling apart.

By proceeding in this manner, the high pressure differential, produced by applying a high positive pressure to the inside of the perforated walls in the mould, will cause so much of the liquid between the particles to be expelled and the particles to come into such mutual engagement, that a shaped body having a considerable mechanical strength is produced, and as the slurry has already been homogenized, the shaped body will have a uniform structure throughout its volume.

If the squeezing-out of the liquid occurs at the same time over the whole surface of the mould, there is a risk that dewatered and un-dewatered material moves about uncontrollably in the moulding space with the result that the end product does not become fully homogeneous. This disadvantage may be avoided by proceeding as set forth by the use of a mold, in which the perforations are distributed and adapted in such a manner so that the liquid will be expressed first from the parts of the mold situated most distant from the slurry inlet, then from parts of the mold less distant from said inlet, then from parts still closer to the inlet and so forth, until the complete molding space is occupied by closely packed and consolidated particulate material forming a compact body with very low porosity.

When proceeding in this manner, the final part of the pressing process, when no further water can be squeezed out, can be characterized as powder pressing.

Thus, the process as such commences in the form of high-pressure slurry pumping in one end of the mould and terminates as a powder-pressing process steadily progressing from the other end of the mould. It will be understood that in this case, the low-viscosity suspension will have no difficulty in flowing out into all nooks and crannies of the mould, and any air having been trapped during the filling-up of the mould will leave the mould cavity through its perforations together with the surplus liquid. The finished press-moulded object will constitute an accurate replica of the internal surfaces of the mould, and since the composite material already has solidified in the mould in the same moment as all surplus water has been squeezed out and mutual contact between the solid-matter particles has been achieved, it is now possible to remove the moulded object from the mould immediately—just as with any other powder-pressing method—since this object is now fully rigid and self-supporting and requires no more than being allowed to harden completely by hydration in a suitable manner.

Similar results with regard to making the dewatering and consolidation process progress steadily from one end or side of the mould to the other may be achieved by A) using a mold in which the liquid-permeability of the perforations diminishes steadily from the end of the mold most distant from the inlet towards the latter so as to make the removal of the liquid occur at the highest rate at said most distant end and at a steadily diminishing rate when approaching the inlet or B) use of a mold in which the perforations may be closed and opened from the outside, the removal of the liquid being carried out by opening the perforations in a sequence beginning at the point in the mold most distant from the inlet and ending at the latter.

The perforations or holes in the walls of the moulds should, of course, be extremely fine, so that the water, but not the solid-matter particles may escape from the mould, but since water molecules are extremely small (approximately 20 Å), this should not be a problem.

The end product made by proceeding according to one of the embodiments of the method according to the invention is characterized by being exceptionally dense and with an absolute minimum of porosity and being highly homogeneous, and by, in the fully-hardened condition, to possess valuable physical properties comprising an optimum combination of strength and toughness.

Since, as described above, the mixing process is carried out with an arbitrary surplus amount of liquid, and the concentration of the material subsequently during the casting or moulding process is increased without "de-mixing" taking place, until no more liquid can be squeezed out from the confined material, it is possible in this case to achieve a considerably higher concentration of fibres in the end product than by using any other known moulding or casting principle, still with the fibres lying fully dispersed and well distributed and oriented throughout the product.

During the terminal part of the pressing process, during which the solid particles are closely wedged and pressed together, so that the material solidifies, the particles are also pressed firmly against all fibre surfaces—in certain cases even into the surfaces of the fibres—resulting in optimum bond between the fibre and the matrix material and hence optimum fibre effect in the end product.

In this process, fibres and matrix material "grow together" in a manner not being known from other casting or moulding processes, and after having fully hardened, the end product possesses unique physical properties.

With uniaxial tension loading, which is the most problematic form of loading to such brittle-matrix materials (because it is difficult for the fibres to take over the whole tensional load when the matrix is over-strained), it is possible with a correctly reinforced BMC (Brittle-Matrix-Composite) material produced according to the present invention to achieve a stress-strain curve more reminiscent of the stress-strain curve for a metal or for a plastic material than for an ordinary brittle matrix material normally exhibiting an ultimate elongation at rupture of only approximately 0.01–0.02 percent (0.1–0.2 mm per m).

After hardening, a correctly made BMC material produced according to the present invention will have a tensile stress-strain curve exhibiting so-called strain hardening, in which the tensile stress continues to increase—without any formation of visible or harmful cracks—even right up to a strain of 1–2% or more. Thus, the strainability (elasticity or flexibility if so preferred) of the matrix material has, by extreme utilization of the admixed fibres, been increased by a factor of 100 or more—and this without causing any damage to the composite material.

The mechanism behind the dramatically increased strainability of the composite material is that the internal rupturing of the matrix material between the fibres due to tensile straining occurs in a different manner than in similar non-reinforced material, as, on a microscopic level, an evenly distributed pattern of extremely fine and short microscopic cracks are formed, increasing in number with increased straining of the material; these microscopic cracks are, however, so small that they may be stopped or blocked by the surrounding fibres, and for this reason they cause no dramatic damage to the material as such.

This is in itself extremely valuable and applies in general to the high-quality BMC materials mentioned above as produced by the methods according to the invention. Further, experience has shown that for so-called FRC material produced with a normal Portland-cement matrix, the network of micro-cracks formed in the manner referred to above (with possible crack lengths of approximately 0.5–1 mm or less, width typically 10–50 $\mu$m) after being formed shows a marked tendency to self-healing, so that the material in the presence of moisture will again be dense, and so that the material when again being tension loaded achieves its original rigidity and strength and may be subjected to increased stresses in the same manner as during the first loading, also here exhibiting a smooth stress-strain curve and a convincing strain hardening with steadily increasing tensile stresses up to an ultimate straining capacity of 1–2% or more before the stresses begin to decrease.

The present invention also relates to an apparatus for carrying out the method of the invention.

Finally, the invention relates to a product comprising a non-flowable body of consolidated, closely-packed particles of solid materials produced by the method and/or apparatus of the invention.

Advantageous embodiments of the method and the apparatus, the effects of which—beyond what is self-evident—are explained in the following detailed part of the present description.

BRIEF DESCRIPTION OF THE DRAWINGS

In the following detailed portion of the present description, the invention will be explained in more detail with reference to the drawings, in which.

DESCRIPTION OF THE PREFERRED EMBODIMENT

Figure 1:
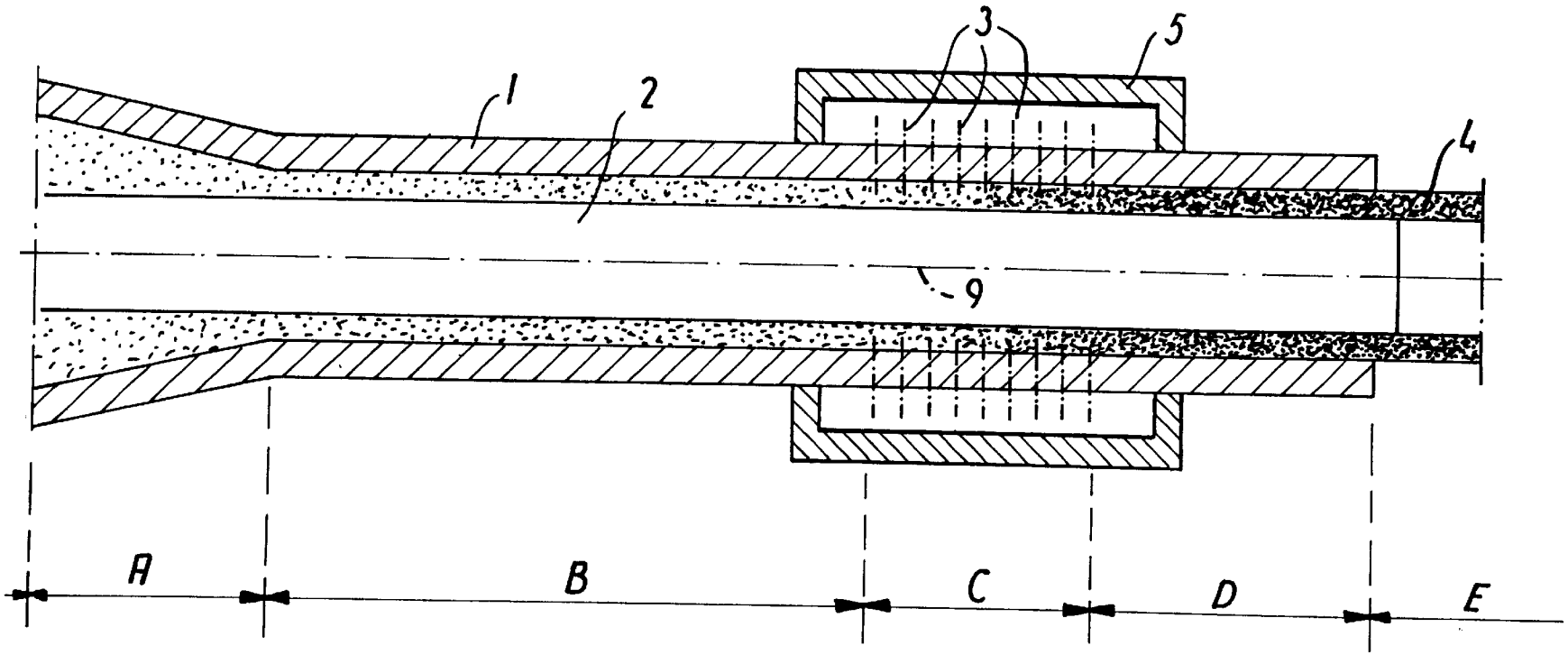
FIG. 1 is a diagrammatic longitudinal sectional view through the parts of an extruder relevant to the invention.

FIG. 1 shows the parts of an extruder essential to the invention, specially designed for producing tubular products, it being obvious that an extruder based on the same principles could also be used for extruding products with other cross-sectional shapes, such as flat or corrugated sheets or profiled stock of various cross-sectional shapes.

The parts of the extruder shown comprise an outer part 1, an inner part 2, a plurality of nozzles or slits 3 for draining-off liquid, as well as a pressure-regulating chamber 5.

As shown, the extruder is divided into four consecutive sections, i.e.

- an inlet section A for the supply of flowable suspension to be compacted, and
- a flow section B, in which the suspension having been supplied flows towards
- a drainage and consolidation section C leading into
- a solid-friction section D.

Further, FIG. 1 shows a further section, designated the exit section E, in which the extruded product leaves the extruder.

For ease of understanding, FIG. 1 shows the above-mentioned sections as quite distinct from each other, but in practice, two or more sections may overlap to a greater or lesser degree. Thus, the nozzles 3, shown in FIG. 1 as solely being present in the drainage and consolidation section C, may well also extend along at least a part of the solid-friction section D.

In the inlet section A, a flowable suspension containing the requisite amounts of powder, liquid (normally water) and possibly further components flows into the flow section B. The suspension supplied to the extruder comprises a surplus of water or other liquid, making it possible to achieve a good and homogeneous intermixing of the components of the suspension, that may have a consistency ranging from a thin slurry to a thick paste. Preferably, the ratio between liquid and dry matter is 1:1.

The mixing process may be carried out in a manner known per se, i.e. by using a high-performance mixer producing a paste-like particle suspension with the desired flowability, prior to supplying the latter to the inlet section A of the extruder by means of a high-pressure pump of a type capable of pumping material of this kind.

From the inlet section A, the suspension flows in the forward direction through the flow section B. The cross-sectional shape of the shaped product in this section B and the subsequent drainage and consolidation section C is determined by the internal shape of the outer part 1 and the external shape of the inner part 2. In the drainage and consolidation section C, surplus liquid is drained off, and the suspension is consolidated to form a solid material with direct contact between the individual particles throughout the product, as substantially all surplus liquid, i.e. substantially all liquid not remaining to occupy the interspaces between the closely packed particles in direct mutual contact, is removed. This draining-off function is caused by the pressure differential across the outer part 1 in the drainage and consolidation section C being applied to the nozzles or slits 3. The pressure differential constitutes the difference between on the one hand the hydrostatic pressure in the suspension in the flow section B and part of the drainage and consolidation section C, which may lie in the range of 20–400 bar, and on the other hand the pressure within the pressure-regulating chamber 5, that may be atmospheric pressure or somewhat higher or lower, as will be explained below.

Obviously, the high hydrostatic pressure reigning in the flow section B and at least the adjacent part of the drainage and consolidation section C can only be maintained, if the part of the extruder downstream of the drainage and consolidation section C comprises some means of obstructing flow. In the method according to the present invention, these means are provided by the non-flowable extruded product resulting from the drainage and consolidation described above, being present in the solid-friction section D. In this section D, the friction between the product 4 and the walls of the outer part 1 and the inner part 2 in contact with it is sufficient to provide a reaction force of substantially the same magnitude as the oppositely acting hydraulic force resulting from the hydraulic pressure upstream of the solid-friction section D. In operation, the supply pressure and the pressure in the pressure-regulating chamber 5 are attuned to each other and to the friction referred to in the solid-friction section D so as to allow the product 4 to advance at a suitable speed.

When the product 4 leaves the extruder in the exit section E, its porosity is extremely low and it contains substantially no more liquid than that occupying the interspaces between the closely packed particles, so that the product 4 is now rigid and has a sufficient dimensional stability to withstand handling during the subsequent processing without being deformed due to its own weight. Such subsequent processing may i.e. be firing in the case of a product containing clay, or hardening in the case of a product based on cement.

When starting-up the process, it is necessary to provide the reaction force referred to above by separate means, as the non-flowable product part has not yet been formed in the solid-friction section D. This may suitably be achieved by inserting a reaction-force plug (not shown) into the downstream end of the interspace between the outer part 1 and the inner part 2 so as to effect a temporary closure.

As soon as the non-flowable "plug" of consolidated material has been formed in the solid-friction section D, it will normally provide a sufficient reaction force, but will on the other hand, of course, require a considerable force to act upon it to overcome the friction against the extruder walls and move it forward.

With an extruder constructed according to the principle shown in FIG. 1, it may not always be possible to attune the pressures referred to above in such a manner, that the consolidated product in the solid-friction section D will be moved, as an increase in the supply pressure, i.e. an increase in the inlet section A and in the flow section B, may cause the friction between the consolidated product and the extruder walls to produce a reaction force that will always be too high. The effects of this high frictional force may be reduced in a number of different ways to be explained below.

A first method of reducing the effect of friction between the consolidated material and the walls of the extruder consists in subjecting the exit portion of the extruder or a part of same to mechanical vibrations. The frequency of these vibrations may lie in the interval 10–400 Hz, while the interval 20–200 Hz is preferred and the interval 50–150 Hz is more preferred.

Another method of reducing the effect of the high friction referred to above is to subject the flowable suspension upstream of the consolidated product to pressure variations, so that periods with a first, lower pressure alternate with second, shorter periods with a second, higher pressure, said second pressure being approximately 1.5–8, preferably 2–4 times greater than said first pressure.

A third method of reducing the effect of the high friction referred to above is to vary the pressure in the pressure-regulating chamber 5, so that the surface of the product in some periods is subjected to reduced pressure to support the draining-off process, and in other periods being subjected to a high-pressure to reduce the friction between the product and the extruder walls.

A fourth method of reducing the effect of the high friction referred to above is based on using an extruder, in which a first part, i.e. the outer part 1 shown in FIG. 1, is capable of being reciprocated in the longitudinal direction relative to another part of the extruder, e.g. the inner parts 2. With such relative movement, that may e.g. be effected by using a crank mechanism (not shown), the product 4 will be made to "walk" stepwise in the downstream direction. The stepwise "walking" movement of the product is achieved through the following mechanism: When both parts of the extruder are stationary, the resulting frictional force between the product and the extruder walls will act in the upstream direction with a magnitude always equal to the resulting force on the product in the downstream direction from the pressure in the flowable suspension. However, when the movable part of the extruder is moved in the downstream direction, the friction stresses between the product and the movable extruder wall will change direction and result in a frictional force in the downstream direction. In this situation it is possible to attune the pressure in the flowable suspension in such a way that the resulting frictional force acting in the downstream direction together with the resulting force from the pressure in the flowable suspension is larger than or equal to the resulting frictional force acting in the upstream direction, thus causing the product to move in the downstream direction. When the movement of the extruder is stopped or changed to the upstream direction, the resulting frictional forces on the product from both parts of the extruder will again act in the upstream direction causing the movement of the product to stop. It follows from the above that an extruder working according to this principle should be designed taking into consideration the cross-sectional area of the product, the working pressure in the flowable suspension and the size and frictional characteristics of on the one hand the surface between the stationary part of the extruder and the product and on the other hand the surface between the movable part of the extruder and the product.

Figure 2:
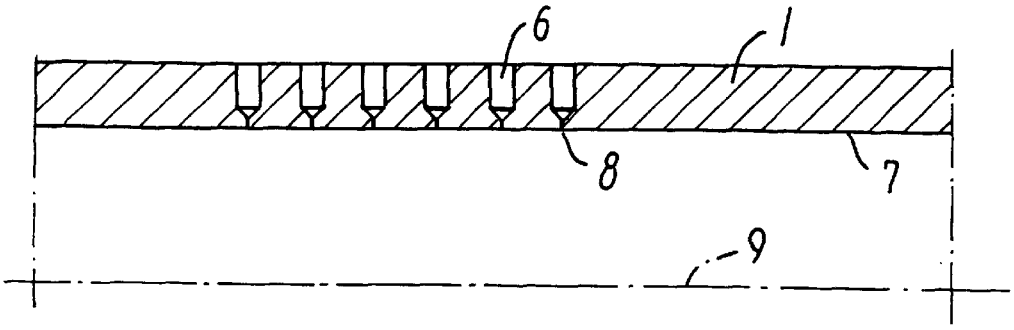
FIG. 2 shows an example of the formation of draining openings in the part of the extruder wall constituting the drainage section.

FIG. 2 shows one example of how the requisite permeability of the extruder wall in the drainage and consolidation section C may be achieved. Thus, in the outer part 1 a number of holes 6 have been drilled into the outer part 1 from the outside. As shown, the holes 6 only extend to within approx. 1 mm from the inside wall 7. In the latter, a plurality of extremely fine perforations 8 with transverse dimensions of the order of 0.001–0.01 mm extend through the respective drilled holes 6. The perforations 8 may be produced by means of e.g. spark erosion or by using a laser beam. FIG. 2 also shows the central axis 9 of the extruder.

Figure 3:
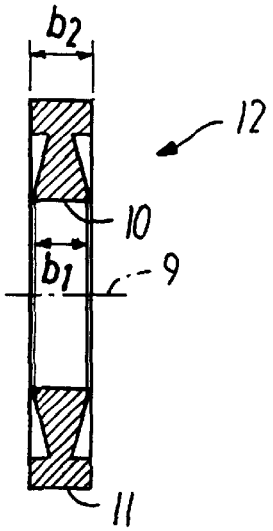
FIG. 3 is a sectional view through a ring adapted to co-operate with a number of similar rings to form an extruder wall with draining slits.
Figure 4:
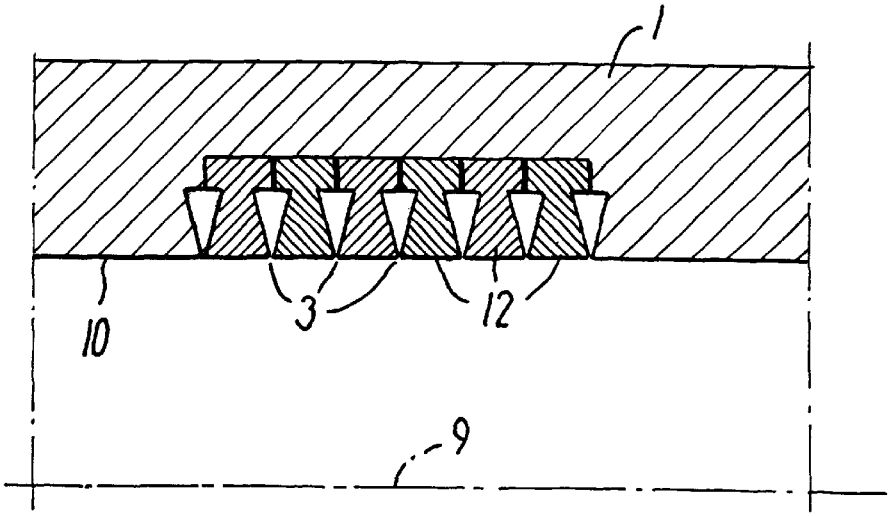
FIG. 4 shows a part of an extruder wall composed of a number of rings of the kind shown in FIG. 3.

Another way of providing the requisite openings in the drainage and consolidation section C is shown in FIGS. 3 and 4. Thus, FIG. 3 shows a ring to be used for this purpose, and FIG. 4 shows how a number of such rings are assembled to form a number of slits constituting said openings.

The ring 12 shown in FIG. 3 comprises an inner periphery 10 and an outer periphery 11. The width $b_1$ of the inner periphery 10 is a trifle, typically approximately 0.001–0.01 mm, less than the width $b_2$ of the outer periphery 11. Thus, when a number of rings 12 are clamped axially together in the extruder, slits 3 will be formed between them with a width of typically approximately 0.001–0.01 mm in the drainage and consolidation section C, through which the liquid to be drained off may escape.

FIG. 4 shows a number of rings 12 of the kind shown in FIG. 3 mounted in the axial direction in the other part 1 of the extruder, so that the inner peripheries 10 of the rings are aligned with the inside surface of the outer part 1 of the extruder. FIG. 4 shows the outer parts 1 and a plurality, in this case a total of six, individual rings 12 with the drainage slits 3 between the rings. The central axis 9 of the extruder will also be seen.

What is claimed is:

1. A method for producing shaped bodies in which all surfaces are formed by an extruder by a) forming a flowable suspension of particulate material in a suitable liquid as an easily flowable moulding slurry wherein said liquid occupies interspaces between said particulate material, b) introducing said suspension into a complete moulding space with at least partly liquid-permeable walls, c) removing at least a major portion of said liquid by establishing a pressure differential across at least parts of said walls that are permeable to said liquid, so as in said complete moulding space to form a non-flowable, shaped body of said material, and d) removing said non-flowable, shaped body from said complete moulding space by reducing effects of friction in said complete moulding space, wherein step a) above includes homogenization of said suspension with a ratio between liquid and dry matter of 1:1 by weight, and wherein steps b) and c) above are carried out by pumping slurry into a closed extruder defining said complete moulding space and having a slurry inlet and finely perforated walls such that the method commences as a high-pressure slurry pumping process and terminates as a powder-pressing process and by applying a sufficiently high pressure to said slurry in said extruder to establish said pressure differential with a magnitude of 50–400 bar to consolidate said particulate material into said non-flowable, shaped body, whereby substantially all of said liquid in said interspaces is expelled from said complete moulding space such that said particulate material in said complete moulding space comes into close mutual engagement and said complete moulding space is occupied by closely packed and consolidated particulate material forming said non-flowable, shaped body having very low porosity, a uniform structure and considerable mechanical strength to thereby provide form stable bodies having sufficient mechanical strength to be handled immediately after leaving said extruder.

2. Method according to claim 1, wherein perforations in the walls are closed and opened from outside, the removal of the liquid being carried out by opening the perforations in a sequence beginning at a point in the complete moulding space most distant from the inlet and ending at the inlet.

3. Method according to claim 1, wherein the liquid is drained off through pores or slits with a diameter or width of less than approximately 0.5 mm.

4. The method according to claim 1 wherein the step of removing said non-flowable, shaped body from said complete moulding space by reducing effects of friction comprises subjecting at least a part of an exit portion of the extruder to mechanical vibrations.

5. The method according to claim 1 wherein the step of removing said non-flowable, shaped body from said complete moulding space by reducing effects of friction comprises subjecting the flowable suspension to pressure variations.

6. The method according to claim 1 wherein the step of removing said non-flowable, shaped body from said complete moulding space by reducing effects of friction comprises varying the pressure differential applied to a surface of the material during said step of removing at least a major portion of said liquid.

7. The method according to claim 1 wherein the step of removing said non-flowable, shaped body from said complete moulding space by reducing effects of friction comprises reciprocating portions of the extruder in a longitudinal direction.

8. Method according to claim 1, wherein the flowable suspension contains fibres distributed in the suspension as well as in the consolidated material of the non-flowable body.

9. Method according to claim 8, wherein the fibers are high-strength fibers, selected from the group consisting of carbon fibers, cellulose fibers, steel fibers, glass fibers, polyolefine fibers, polypropylene fibers and ultra-fine fibers and wherein the degree of reinforcement expressed as the fiber volume fraction in said consolidated material of the non-flowable, shaped body is 1–15%.

10. Method according to claim 1, wherein the perforations are distributed so that said liquid is expressed first from the complete moulding space situated most distant from the slurry inlet, then from the complete moulding space less distant from said inlet, then from the complete moulding space still closer to said inlet, until the complete moulding space in its entirety is occupied by closely packed and consolidated particulate material forming a compact body with very low porosity.

11. Method according to claim 10, wherein liquid-permeability of said perforations diminishes steadily from an end of the complete moulding space most distant from the inlet towards the inlet so as to make the removal of the liquid occur at a highest rate at said most distant end and at a steadily diminishing rate when approaching the inlet.

12. Method according to claim 10, wherein said flowable suspension contains particulate material selected from the group consisting of materials containing clay, materials based on hydraulic cement, calcium-silicate materials and materials containing gypsum.

13. Method according to claim 1, further comprising passing said suspension through an extrusion duct of the extruder, the extrusion duct having a substantially constant cross-sectional shape and size, and removing liquid from the suspension by means of a pressure differential across parts of walls of the extrusion duct having openings allowing said liquid but not particles to leave the extrusion duct so as to convert the suspension to the non-flowable body having a cross-sectional shape corresponding to the cross-sectional shape of the extrusion duct, wherein the pressure differential is established and maintained by applying a high super-atmospheric pressure to said suspension at or upstream of its entry into the extrusion duct and applying or permitting a substantially lower pressure to reign on an exit side of said openings, and wherein the pressure differential and the liquid-outflow capability of said openings are mutually attuned so that a part of said non-flowable body at any time downstream-most in the extrusion duct engages the walls of the extrusion duct with a frictional force sufficient to withstand said pressure applied to the suspension.

14. Method according to claim 13, wherein the pressure differential and the liquid-outflow capability of said openings are mutually attuned so that said frictional force allows said non-flowable body to move in a downstream direction under an influence of said pressure applied to the suspension.

15. Method according to claim 13, wherein the downstream part of the extrusion duct is subjected to vibration in order to reduce an effect of friction between the consolidated material and the extrusion duct walls.

16. Method according to claim 13, wherein the flowable suspension upstream of drained and consolidated material is subjected to varying pressure, so that periods with a first, lower pressure alternate with shorter periods with a second, higher pressure, said second higher pressure being approximately 1.5–8 times greater than said first pressure.

17. Method according to claim 13, wherein a surface of the non-flowable body is subjected to varying pressure from a pressure-regulating chamber surrounding a draining section.

18. Method according to claim 13, wherein the fibers are oriented in a desired manner throughout at least a part of a cross-section of the consolidated material of the non-flowable body by adjusting conditions of introduction and consolidation of the suspension, wherein an introduction of the suspension through the slurry inlet having a converging cross-sectional shape results in a tendency to an axial orientation of the fibers, and an introduction of the suspension through the slurry inlet which is tangentially directed results in a tendency to a tangential orientation of the fibers.

19. Method according to claim 13, wherein a shaping part of said extrusion duct is divided longitudinally into at least two parts, that are reciprocated relative to each other in a longitudinal direction in order to ease forward movement of the consolidated material.

20. Method according to claim 19, wherein the shaping part of the extrusion duct is divided longitudinally into two parts, one of said parts being fixed and the other of said parts being reciprocated in the longitudinal direction.

* * * * *